US010329880B2

(12) United States Patent
Lang et al.

(10) Patent No.: US 10,329,880 B2
(45) Date of Patent: Jun. 25, 2019

(54) RAINGUARD FOR OIL WELL TRAPPER BOX

(71) Applicant: WELLSITE GUARD, LTD., Calgary (CA)

(72) Inventors: Victor Lang, Calgary (CA); Elaine Dang, Calgary (CA); Daniel Morin, Calgary (CA)

(73) Assignee: WELLSITE GUARD LTD., Calgary (CA)

( * ) Notice: Subject to any disclaimer, the term of this patent is extended or adjusted under 35 U.S.C. 154(b) by 60 days.

(21) Appl. No.: 15/519,588

(22) PCT Filed: Oct. 20, 2015

(86) PCT No.: PCT/CA2015/000543
§ 371 (c)(1),
(2) Date: Apr. 17, 2017

(87) PCT Pub. No.: WO2016/061661
PCT Pub. Date: Apr. 28, 2016

(65) Prior Publication Data

US 2017/0241240 A1 Aug. 24, 2017

(30) Foreign Application Priority Data

Oct. 21, 2014 (CA) ..... 2868597

(51) Int. Cl.
*E21B 33/03* (2006.01)
*E21B 33/08* (2006.01)
(Continued)

(52) U.S. Cl.
CPC ..... *E21B 41/00* (2013.01); *E21B 33/03* (2013.01); *E21B 33/08* (2013.01); *E21B 43/126* (2013.01)

(58) Field of Classification Search
CPC ..... E21B 33/03; E21B 33/08; E21B 33/037; E21B 41/00; E21B 43/126
See application file for complete search history.

(56) References Cited

U.S. PATENT DOCUMENTS 1,232,534 A * 7/1917 Grodaes ..... E21B 33/03 166/230
4,405,161 A * 9/1983 Young ..... E21B 33/03 137/382

(Continued)

FOREIGN PATENT DOCUMENTS

CA 2495662 A1 2/2004
CA 2422876 A1 9/2004
GB 573695 A 12/1945

OTHER PUBLICATIONS

International Search Report and Written Opinion for International (PCT) Patent Application No. PCT/CA2015/000543, dated Dec. 21, 2015, 10 pages.

*Primary Examiner* — James G Sayre
(74) *Attorney, Agent, or Firm* — Bennett Jones LLP

(57) ABSTRACT

A rainguard device for insertion on top of a stuffing box containment basin, said device comprises: a top portion; a shield; and a base ring; wherein said top portion comprising a flat circular upper section connected at its underside to a neck connected to a lower section; said neck is adapted to be inserted into an aperture present at a top section of the shield; said top portion having a vertical central aperture going therethrough adapted to receive a polish rod; said shield comprising two halves and having a frusto-conical top portion and defining an aperture at the top thereof and having a cylindrical bottom section; said bottom section defining an aperture and adapted to be inserted into the base ring; said base ring comprising two halves each of which comprising: a lower edge adapted for insertion into the (Continued)

inside of said basin; a middle ring portion supporting an inner lip and an outer lip, both inner and outer lips extending updwardly from the middle ring portion and both lips extending around the circumference of the middle ring portion; said inner lip and outer lip defining therebetween a channel adapted to receive an edge of the bottom portion of the shield; and wherein the base ring is adapted to rest on a top edge of the stuffing box containment basin.

16 Claims, 12 Drawing Sheets

(51) Int. Cl.
*E21B 41/00* (2006.01)
*E21B 43/12* (2006.01)

(56) References Cited

U.S. PATENT DOCUMENTS

| | | | | |
|---|---|---|---|---|
| 4,871,327 | A | 10/1989 | Ridgway et al. | |
| 5,150,751 | A | 9/1992 | Burton et al. | |
| 5,157,816 | A | 10/1992 | Huessler | |
| 5,246,067 | A | 9/1993 | Heinonen et al. | |
| 5,351,753 | A | 10/1994 | Golson | |
| 5,394,939 | A * | 3/1995 | Walker | E21B 33/08 166/81.1 |
| 5,484,024 | A | 1/1996 | Ladd et al. | |
| 5,540,283 | A | 7/1996 | Hahn | |
| 5,857,518 | A | 1/1999 | Vinson, Sr. | |
| 8,127,838 | B2 | 3/2012 | Brewer et al. | |
| 2002/0179300 | A1 * | 12/2002 | Gay | E21B 33/08 166/81.1 |
| 2011/0232896 | A1 * | 9/2011 | Brewer | E21B 33/08 166/81.1 |

* cited by examiner

RAINGUARD FOR OIL WELL TRAPPER BOX

CROSS REFERENCE TO RELATED APPLICATIONS

This application is a national stage application under 35 U.S.C. 371 and claims the benefit of PCT Application No. PCT/CA2015/000543 having an international filing date of 20 Oct. 2015, which designated the United States, which PCT application claimed the benefit of Canadian Patent Application No. 2,868,597 filed 21 Oct. 2014, the disclosure of each of which are incorporated herein by reference.

FIELD OF THE INVENTION

A rainguard device to be used on top of a stuffing box on an oilwell, more specifically, the device is a rainguard to be installed on top of a stuffing box containment basin.

BACKGROUND OF THE INVENTION

In the oilfield industry, the first area of concern for oil spills and leaks is directly at the wellhead. Despite the fact that most drilling activities are carried out in remote areas, oil spills are always a concern even more nowadays that environmental concerns have taken center stage in the discussion about the exploitation of such resources.

Many devices have been developed in order to address oil spills at wellhead. These devices are commonly referred to as stuffing box containment devices. The stuffing box containment devices are assembled in such a manner as to cover the wellhead and provide a drain to recover the oil collected in device. With varying degrees of success they have been widely implemented in the oil industry.

However, stuffing box containment devices have sensors which alert oil companies as to the fluid levels inside the containment device. In periods of rain, the containment devices collect rain as well as oil and emit false signals to oil companies which must dispatch workers to go verify the status of the containment device. Shut downs caused by rain water filling the basin are considered "false shut-downs" and are an annoyance to oil companies as they are costly. This problem has been addressed by a number of devices but each one having different and unexpected drawbacks.

U.S. Pat. No. 5,484,024 discloses an expandable and contractible covering is over the polished rod and the polished rod liner from above the polished rod liner clamp to below the stuffing box. This covering protects the environment in the event of failure of the liner or stuffing box. The covering may be quickly released from a basin below the stuffing box and contracted upward to service the stuffing box. The basin is connected to a special fitting between the stuffing box and pumping tee.

U.S. Pat. No. 5,351,753 teaches a leak containment system for a stuffing box. The cap is shaped similar to the bottom tray in that it has an outer circumferential edge that has an inner diameter slightly less than the outer diameter of a cowling to provide a snug fit therefor. A hole is disposed in the upper surface of the cap to allow the polish rod to reciprocate therethrough. The hole can be substantially equal to the outer diameter of the polish rod, allowing for tolerances during the reciprocation thereof.

U.S. Pat. No. 5,150,751 teaches a stuffing box containment device. This device contains and collects leaks from the stuffing box of a fluid producing wellhead. It comprises collection means carried by the wellhead below the stuffing box and encircling the wellhead and at least two separate upstanding hollow shapes of such cross-sectional configuration that when they are brought into abutment with one another the volume enclosed within abutting shapes encircles the wellhead and extends from the liquid collection means to above the stuffing box, said shapes having apertured top edge means which form an opening that encircles the polished rod that reciprocates through the stuffing box.

U.S. Pat. No. 8,127,838 teaches a stuffing box containment device. More specifically, the containment apparatus preferably includes a transparent lid or topper. The topper is preferably divided into half portions which can be secured together by a variety of mechanisms. In order to provide a liquid seal, each half portion provides a flange extending from opposite edges of each half portion.

U.S. 2002/0179300 teaches a stuffing box containment device intended for use in containing leaks from an oil well stuffing box which is used to seal around the polish rod which is connected to the rod string. The disclosed apparatus comprises a secondary container which encloses the stuffing box, a drain from the secondary container, and a storage container which is used for collecting any liquids which are drained from the secondary container. The secondary container has an upper seal for sealing around the polish rod, and a lower seal which seals around a member of the production tree. There is also disclosed means for injecting the escaped liquids back into the production system.

U.S. Pat. No. 5,246,067 discloses a stuffing box containment device. It has an annular head mounted on a hood including an integral upwardly extending central flange having a central opening for receiving a polished rod which extends upwardly to a pump operator and downwardly to a downhole pump. An annular seal is mounted in the hood head opening on a flange for sealing in the opening around the polished rod.

CA 2,422,876 discloses a wellhead leak containment and blowout deflection device. This device has a base capped by a detachable two-piece cover or lid. One half of the lid abuts the other half. The lid is split in two so that it may be mounted about the stuffing box and sucker rod without disrupting wellhead operation. The lid has an outwardly and downwardly flared circumferential lip forming a first, or lower, opening. The rainguard on this device is secured to the containment basin and provides no lateral movement for the polish rod.

In light of the above, there is still a need for a rainguard device for use on stuffing box containment devices which provide less installation work for the user, a safer work environment and more resistance to the wear and tear of use.

SUMMARY OF THE PRESENT INVENTION

In accordance with the present invention, there is provided a rainguard device for insertion on top of a stuffing box containment basin, said device comprises:

a top portion;

a shield; and a base ring;

wherein said top portion comprising a flat circular upper section connected at its underside to a neck connected to a lower section; said neck is adapted to be inserted into an aperture present at a top section of the shield; said top portion having a vertical central aperture going therethrough adapted to receive a polish rod;

said shield comprising two halves and having a frusto-conical top portion and defining an aperture at the top thereof and having a cylindrical bottom section; said bottom section defining an aperture and adapted to be inserted into the base ring;

said base ring comprising two halves each of which comprising:

a lower edge adapted for insertion into the inside of said basin;

a middle ring portion supporting an inner lip and an outer lip, both inner and outer lips extending updwardly from the middle ring portion and both lips extending around the circumference of the middle ring portion; said inner lip and outer lip defining therebetween a channel adapted to receive an edge of the bottom portion of the shield; and wherein the base ring is adapted to rest on a top edge of the stuffing box containment basin.

Preferably, the top portion comprises a circumferential groove facing inwardly towards the vertical aperture. More preferably, the circumferential groove is adapted to receive a waterproof ring.

Preferably, the lower section of the top portion is bell-shaped and whose diameter is greater than that of the aperture at the top of the shield. The top portion is designed to allow the vertical movement of a polish rod.

According to one aspect of the present invention, the flat circular upper section of said top portion has a wider diameter than the aperture at the top of the shield. Preferably, the lower section has a wider diameter than the aperture at the top of the shield. And preferably, the neck has a narrower diameter than the aperture at the top of the shield.

Preferably also, the base ring comprises:

a lower edge adapted for insertion into the inside of said basin;

a middle ring portion supporting a inner lip and an outer lip extending updwardly from the middle ring portion;

said inner and outer lips defining therebetween a channel adapted to receive an edge of the bottom portion of the shield; and wherein said base ring is adapted to rest on a top edge of a stuffing box containment basin.

More preferably, the lower edge of the ring being adapted to be removably connected to the inside of the basin. Even more prefereably, the lower edge of the ring can be removably connected to the inside of the basin through at least one bayonet mount present on the base ring interlocking with a pin located on the inside of the basin.

Preferably, the inner lip is adapted to frictionally fit the bottom section of the shield. More preferably, the inner lip is angled outwardly.

Preferably, the outer lip is angled inwardly. More preferably, the outer lip defines at least one aperture in its circumference adapted to allow drainage of fluid.

According to another aspect of the present invention, there is provided a rainguard device for insertion on top of a stuffing box containment basin, said basin and rainguard device adapted to receive a polish rod therethrough, said device comprises:

a top portion;

a shield; and a base ring;

said shield having a frusto-conical top portion and defining an aperture at the top thereof and having a cylindrical bottom section; said bottom section defining an aperture and adapted to be inserted into the base ring; said shield comprising two halves, each half comprising a flange having facing apertures adapted to receive fastening means to maintain said facing flanges from opposite halves in abutment with one another when in use;

wherein said top portion comprises a flat circular upper section connected at its underside to a neck connected to a lower section; said neck is adapted to be inserted into an aperture present at a top section of the shield; said top portion having a vertical central aperture going therethrough adapted to receive a polish rod; said vertical aperture being fitted with a flexible sealing member adapted to abut against said polish rod and provide a seal;

said base ring comprising two halves having edges adapted to be placed in abutment with one another, said ring comprises:

a middle ring portion supporting an outer lip and a inner lip both extending updwardly therefrom and a lower edge extending downwardly from the middle ring portion;

said lower edge being adapted for frictional insertion into the inside of said basin;

said outer lip and inner lip defining therebetween a channel adapted to frictionally receive an edge of the bottom portion of the shield; and wherein the ring is adapted to rest on a top edge of said basin.

The present device allows for the release of toxic gasses which would otherwise build up inside stuffing boxes containment device. This allows for a reduced risk of explosion as there is no gas build up inside the containment device. The presence of ignition source such as static will thus be less likely of causing explosions.

DETAILED DESCRIPTION OF THE INVENTION

The present invention relates to a rainguard device to be used with a stuffing box containment basin. The present invention provides the ability to retain oil inside a containment basin and keep rainwater out of the basin and the while allowing dangerous gasses to be safely release out of the basin/rainguard setup.

According to a preferred embodiment of the present invention, the rainguard device is comprised of 3 main sections. The top section is a free-floating disc that allows for vertical and horizontal movement of the polish rod. The rainguard device will preferably use felt inserts to keep out rain water while at the same time maintain the polish rod lubricated. The middle and bottom sections of the rainguard prevents rain leaking down the sides into the basin but also allows for the shield to be cut at a desired height.

The person skilled in the art will understand that the middle ring portion of the base ring has an outer lip and a inner lip both extending updwardly therefrom which can be vertical or substantially vertical so long as the liquids are maintained as intended, i.e. oil remains inside the basin and rainwater or any other external liquids remain outside of the basin.

Figure 1:
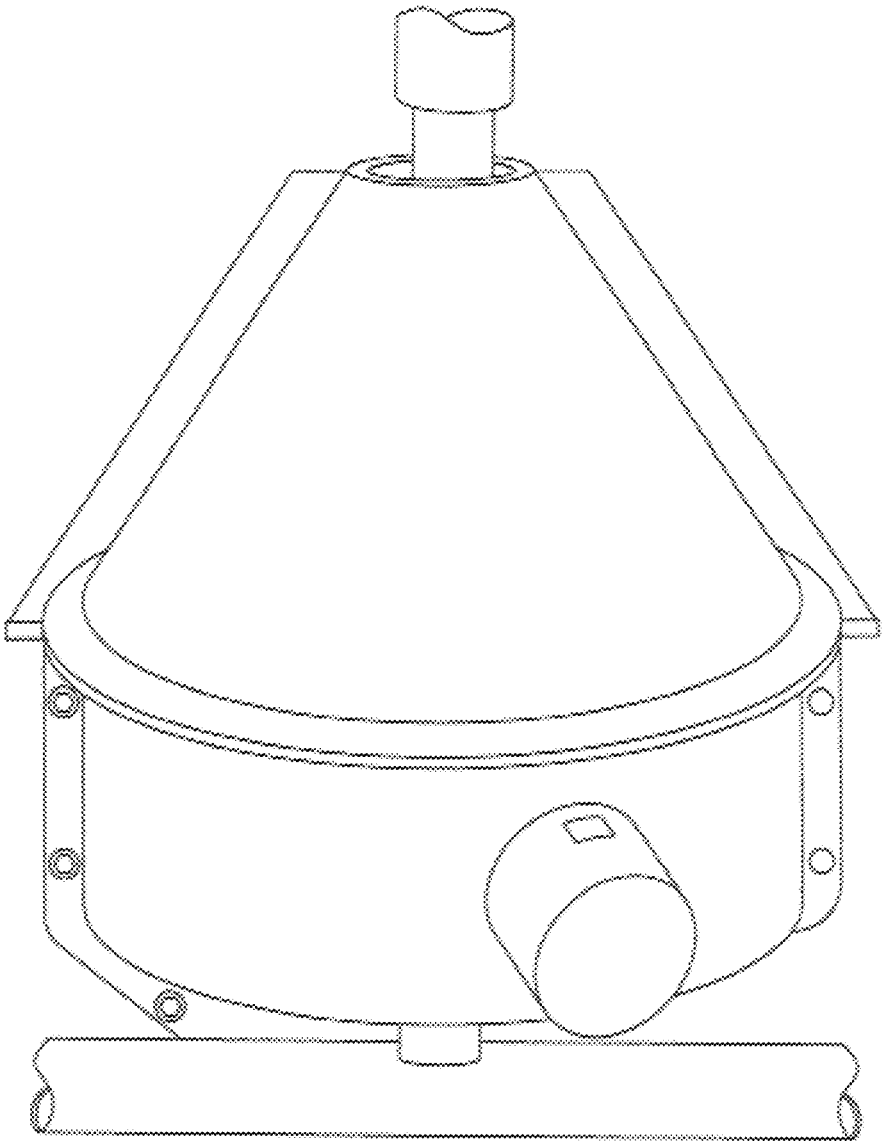
FIG. 1 provides a perspective view of a rainguard device according to the prior art.

In referring to FIG. 1, the prior art device fits on the wellhead of a pump jack in the oilfield. The wellhead is prone to leaking and oil gets on the ground causing expensive clean ups. The prior art rainguard device has an opening at the top thereof which allows the polish rod to move therethrough but the opening also allows water to infiltrate the containment basin and cause false alarms.

Figure 11:
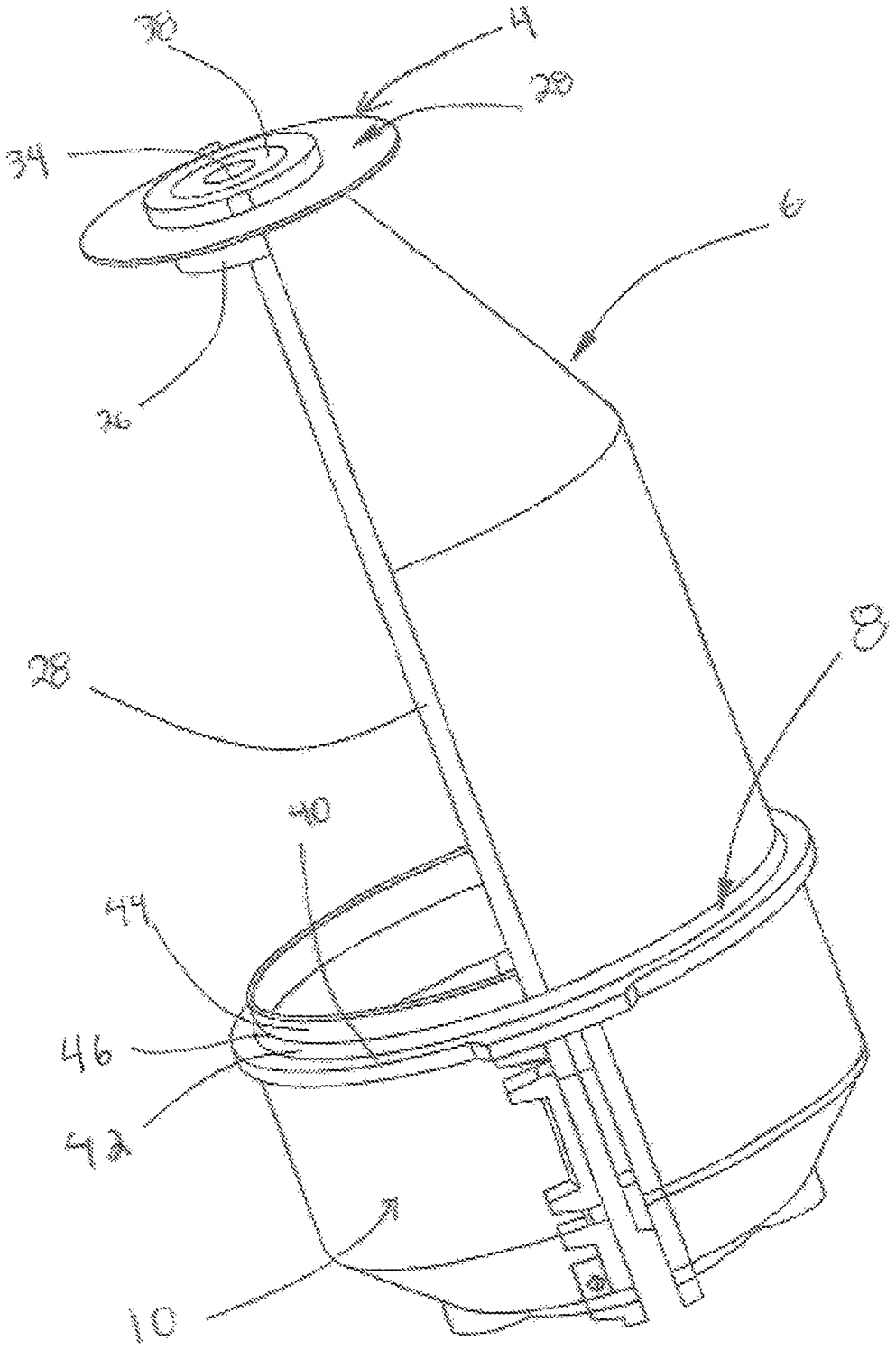
FIG. 11 is a perspective view of the rainguard device according to the present invention mounted on a stuffing box containment basin.
Figure 12:
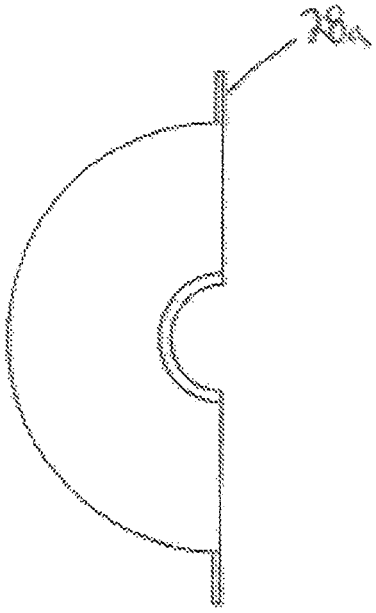
FIG. 12 is a top view of one half of the shield of the rainguard device according to the present invention.
Figure 13:
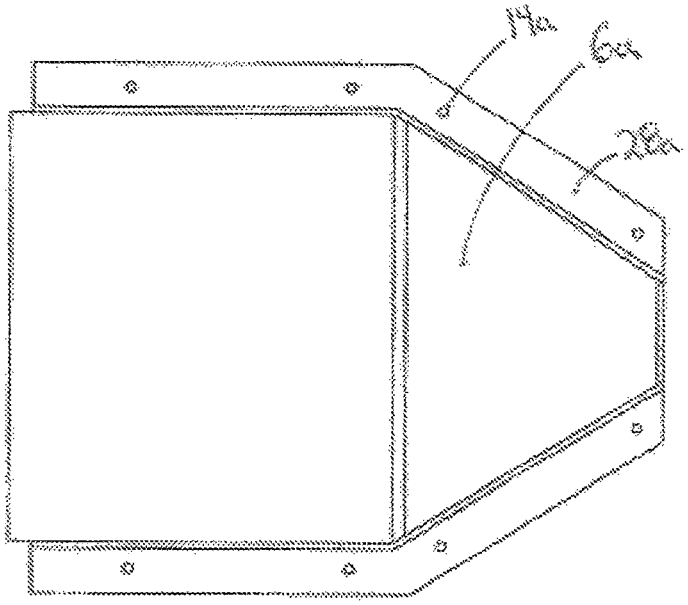
FIG. 13 is a front view of one half of the shield of the rainguard device according to the present invention.
Figure 14:
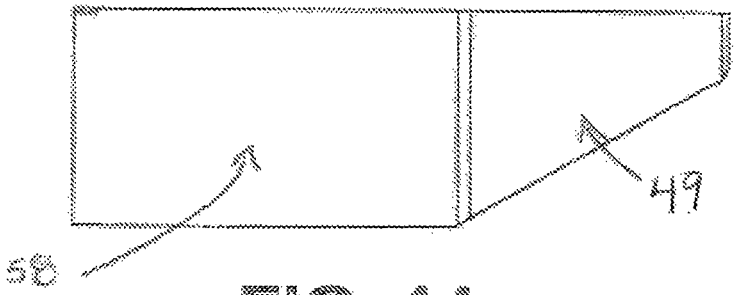
FIG. 14 is a side view of one half of the shield of the rainguard device according to the present invention.
Figure 15:
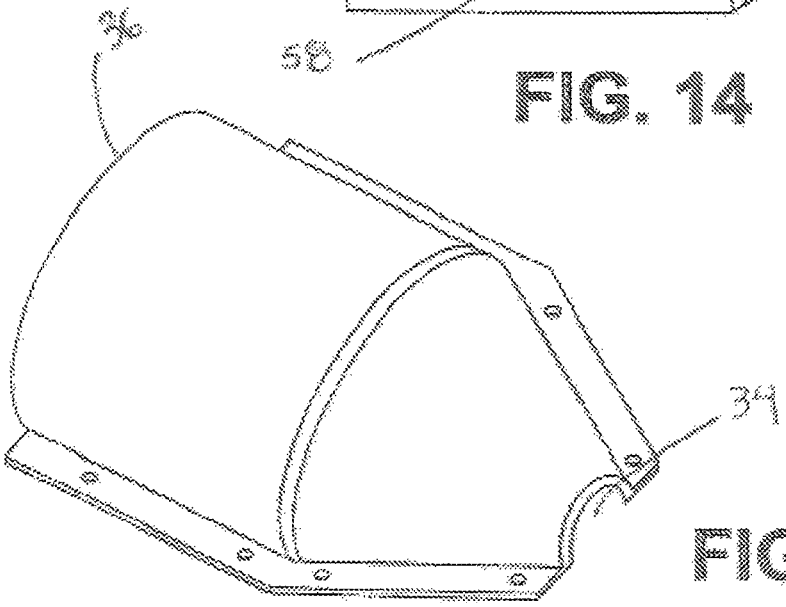
FIG. 15 is a perspective view of one half of the shield of the rainguard device according to the present invention.

In referring to FIG. 11, the device according to the present invention provides a top portion which is adapted to make contact with the polish rod, maintain the rod lubricated and prevent rain from infiltrating the containment basin. Once fully assembled, the top portion of the device, also referred to as the rainguard allows for the lateral movement of the polish rod and therefore renders the rainguard less susceptible to cracking and subsequent breaking because the forces created by the lateral movement of the polish rod. The top portion of the device allows the oil to remain inside the containment device in the event of a blow out and prevents any infiltration of rain into the containment device.

Figure 2:
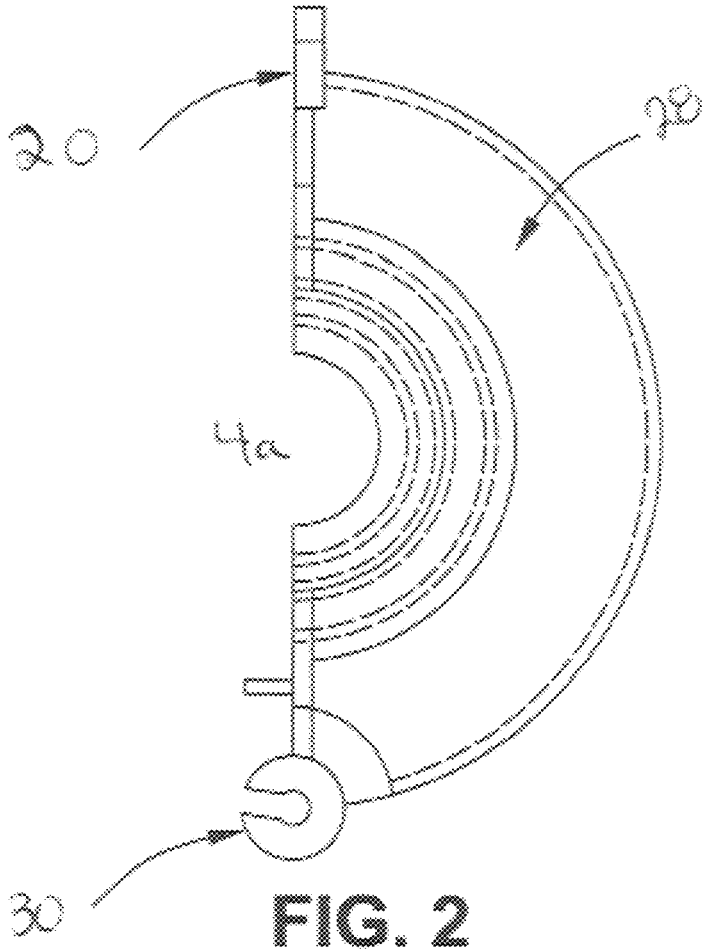
FIG. 2 provides a top view of the latching half of the top portion of the rainguard device according to a preferred embodiment of the present invention.
Figure 3:
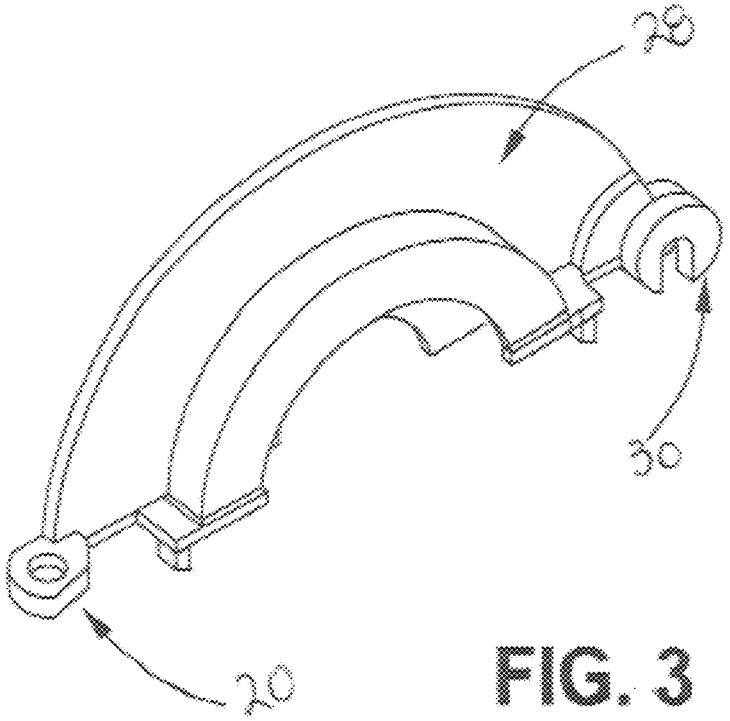
FIG. 3 is a perspective view of the latching half of the top portion of the rainguard device according to the present invention.
Figure 4:
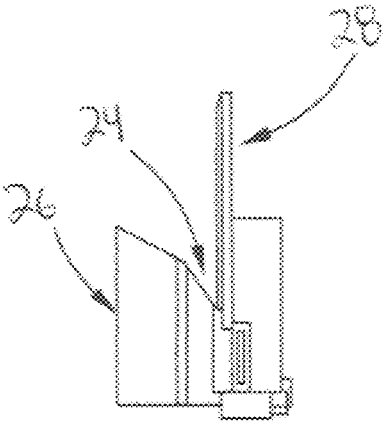
FIG. 4 provides a side view of the latching of the top portion of the rainguard device according to a preferred embodiment of the present invention.
Figure 5:
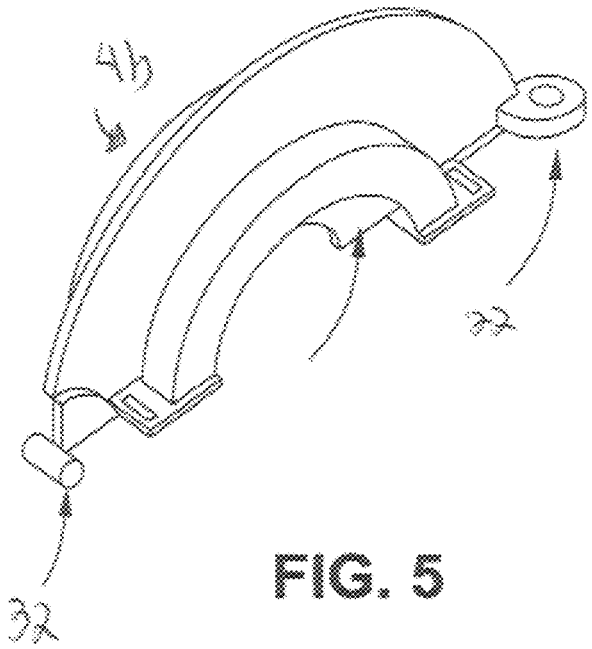
FIG. 5 provides a top view of the latching half of the top portion of the rainguard device according to a preferred embodiment of the present invention.
Figure 6:
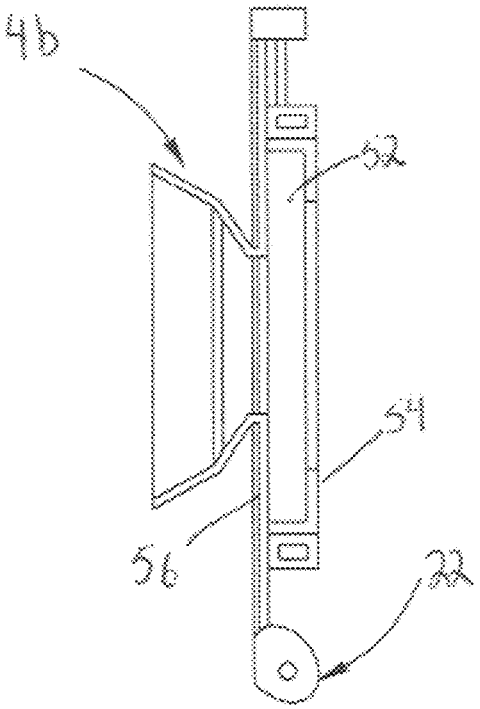
FIG. 6 is a cross-sectional view of the latching half of the top portion of the rainguard device according to a preferred embodiment of the present invention.
Figure 7:
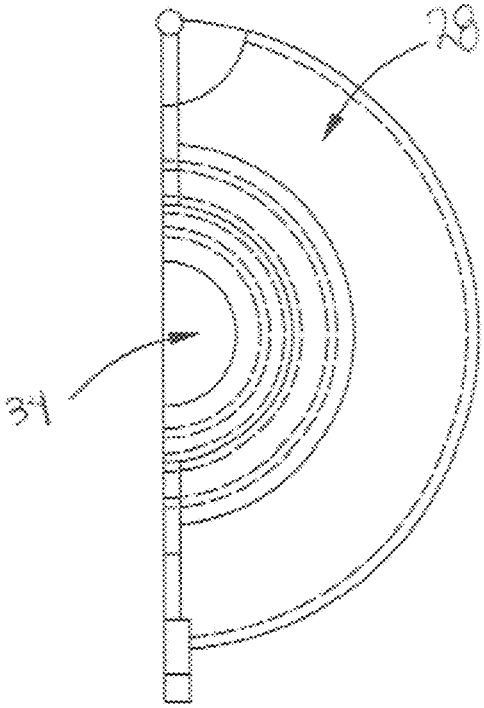
FIG. 7 is a top view of the latching half of the top portion of the rainguard device according to a preferred embodiment of the present invention.

FIGS. 2, 3, 4, 5, 6 and 7 show different views of the top portion of a rainguard according to the present invention. FIGS. 4 and 6 highlight the neck (24) and the bell-shaped bottom section (26) of the top portion (4). FIG. 2 shows the latching section of the top portion of the rainguard device. The semi-circular piece illustrated is intended on being hingedly connected to the pin section of the top portion as illustrated in FIGS. 4, 5, 6 and 7. The extremity (20) is hingedly connected to extremity (22) and operates to close the two semi-circulars halves when installing the rainguard device according to a preferred embodiment of the present invention into the aperture located in the shield, which two halves are subsequently closed and secured in place with fastening means such as screws or bolts with nuts. The opposite extremity of the semi-circular half illustrated in FIG. 2 has a hook recess (30) which is adapted to receive the pins (32) located on the semi-circular half illustrated in FIG. 5. The pins (32) are releasably held in place inside the hook recess (30) through friction.

When both halves (4*a* and 4*b*) are assembled, the top portion (4) provides an upper opening hereinafter referred to aperture (34) adapted to permit motion of a polished rod therethrough. Surrounding the aperture (34) are recessed grooves (52) which go around the entire circumference of the aperture and in which there is inserted a protective material (38) protruding from the groove (52). The recessed grooves (52) are created by the flat top (56) and a semi-circular ring (54) which is slightly elevated from the flat top (56). The protective material (38) can be selected amongst a number of different materials which permit liquid seal all the while prevent damage to the polish rod. The protective material (38) is adapted to make contact with the polished rod but preventing the latter from touching any other section of the device (1) but the protective material.

Figure 9:
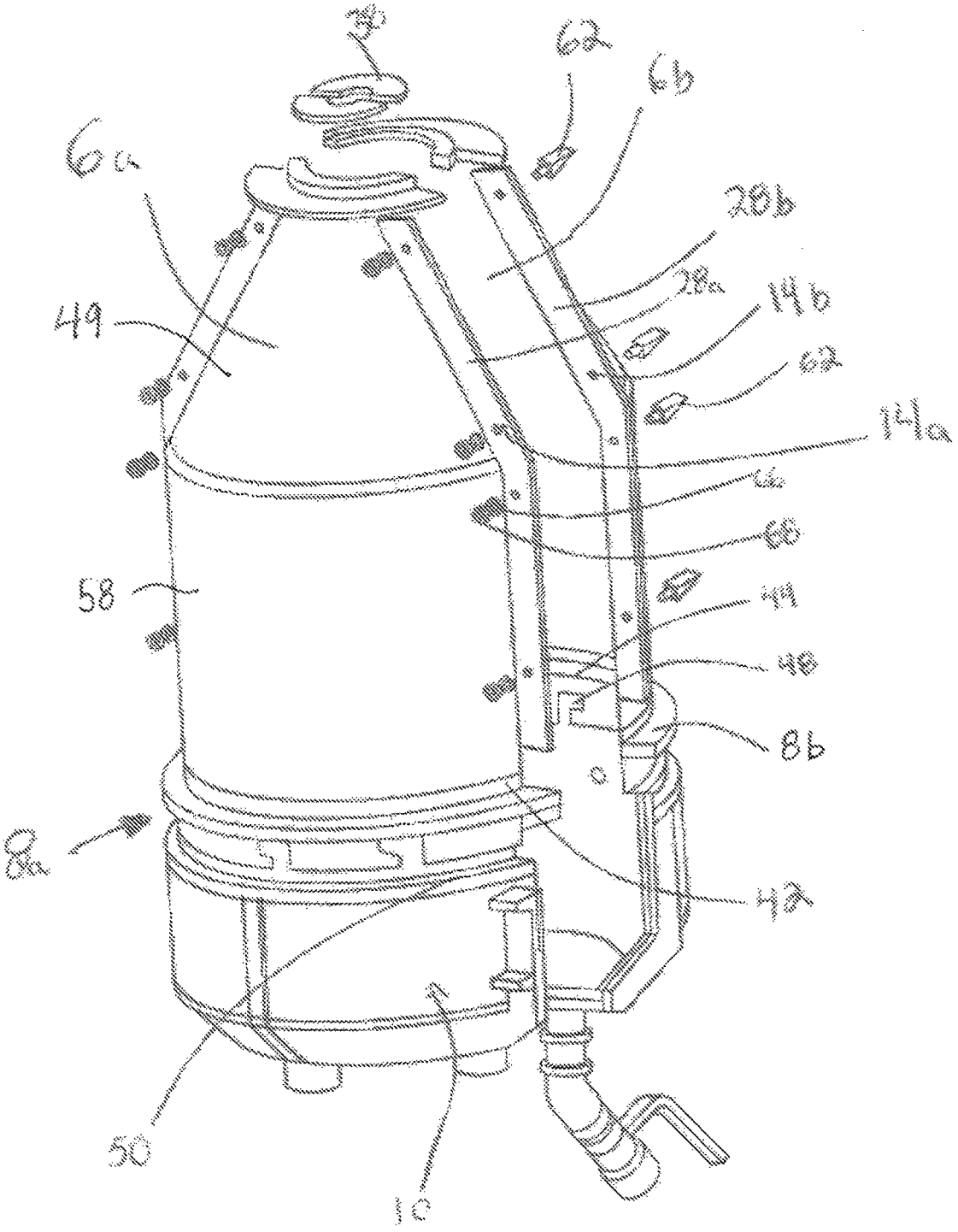
FIG. 9 is an exploded perspective view of the rainguard device according to the present invention mounted on a stuffing box containment basin.

In referring to FIG. 9, once the top portion (4) has been secured around a polish rod, the shield (6) is then assembled by securing one half (6*a*) to the opposite half (6*b*) while ensuring that the neck portion (24) of the top portion (4) is positioned in the aperture (34) located at the top of the shield, said aperture defined by the joining of the two shield halves (6*a* and 6*b*). The apertures (14*a* and 14*b*) located on their respective flanges (28*a* and 28*b*) are aligned and fastening means are inserted therethrough to secure both halves (6*a* and 6*b*) of the shield (6). The flanges from both halves now tightly abutted to one another provide a water-tight seal from rain (on the outside) and oil from the inside.

Once the shield halves (6*a* and 6*b*) have been assembled and secured together, the bottom edge (36) of the shield is inserted into the channel (46) defined by the inner lip (44) and outer lip (42) located on the top surface (40) of the base ring (8).

The shield (6) can be cut to fit various stuffing box heights. In order to do so, the cylindrical bottom section of the shield can be cut around its circumference at the desired height without affecting how the device (1) operates.

The base ring (8) having been previously mounted on the top edge (50) of a stuffing box containment basin (10) by assembling two ring halves (8*a* and 8*b*) and securing them on bayonet mounts (48) located on the inside wall of the basin (10). According to an embodiment of the present invention illustrated in FIG. 10, the outer lip (42) has a opening in its circumference at the location where the flanges (28*a* and 28*b*) of their respective shield halves (6*a* and 6*b*) meet. This allows for the rainwater runoff to exit the channel (46) and drip off onto the base ring (8) and subsequently to the ground. This maximizes the quick and efficient drainage off the rainguard device (1).

FIG. 11 best illustrates the assembled device. Thus, assembled the rainguard device (1) (not showing one half of the shield (6) allows a polish rod (not shown) to reciprocate in and out of the aperture (34) with a seal (38) maintaining a liquid seal around the polish rod and the top portion (4) of the device (1) capable of some lateral movement through the aperture (34) to absorb vibrations in the polish rod as well as to allow lateral movement of such. This freedom to move laterally allows to minimize breakage of the shield and/or the top portion by preventing torsion of the plastic or knocking on it.

FIG. 9 shows the rainguard prior to installation and broadly illustrates the positioning of all the elements with respect to the stuffing box containment basin (10). The bottom part of the device (1) is constituted by the base ring (8) made up by the two ring halves (8*a* and 8*b*). The middle section of the device is constituted by the shield (6) made up by the two shield halves (6*a* and 6*b*) and fastening means made of screws (62), washers (66) and bolts (68) inserted into the apertures (14*a* and 14*b*) located on their respective flanges (28*a* and 28*b*) on the sides on the shield halves (6*a* and 6*b*).

Figure 10:
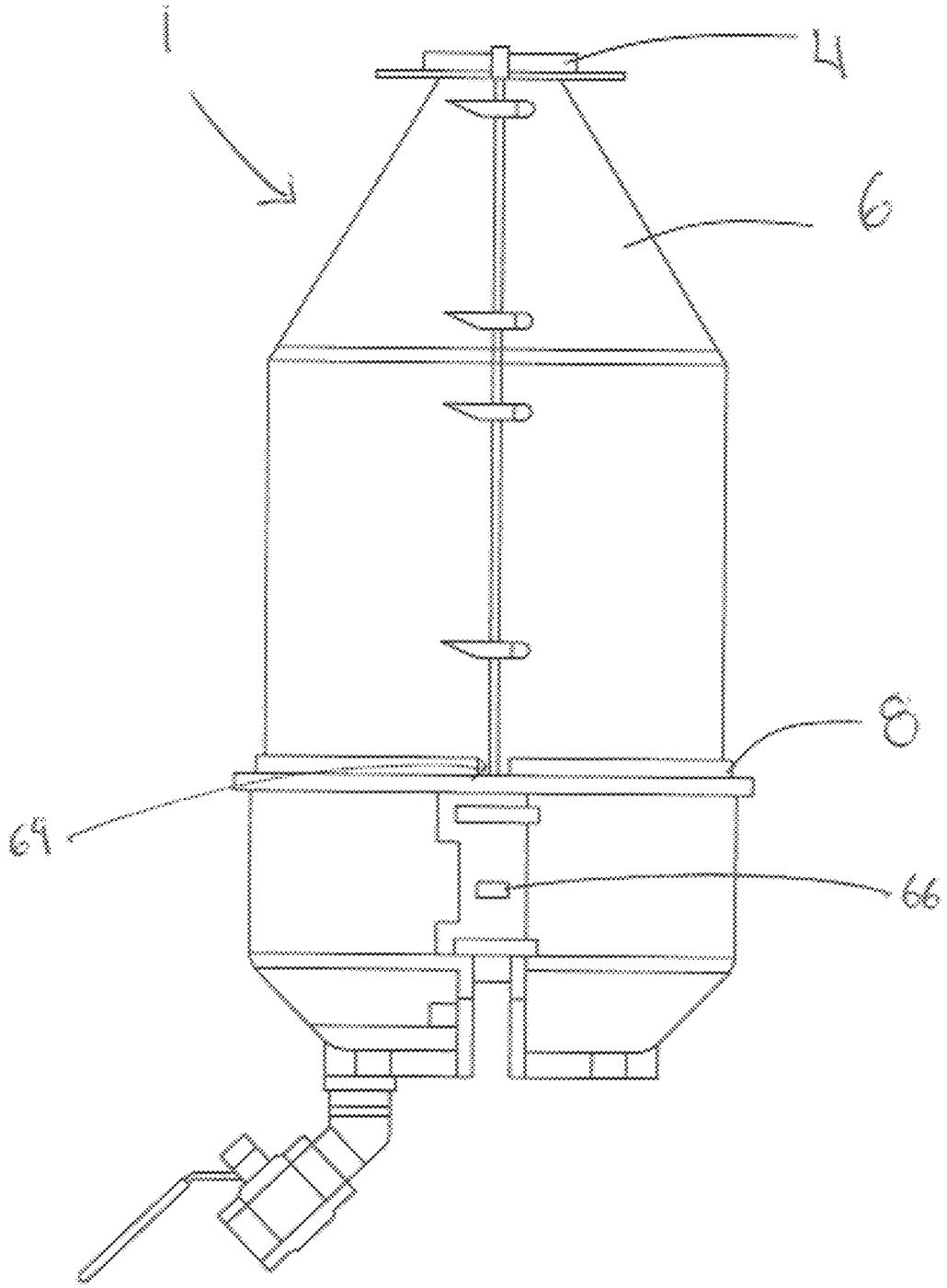
FIG. 10 is a side view of the rainguard device according to the present invention mounted on a stuffing box containment basin.

FIG. 10 shows the device (1) according to an embodiment of the present invention installed on an oil well stuffing box containment basin (10). The device (1) according to this embodiment is installed on a stuffing box containment basin (10) by placing the ring on the top edge (50) of the containment basin (10) and securing mechanism, in this case the ring has bayonet mounts (48) inserted into pins (104) protruding from the inside walls of the basin (10).

In a preferred embodiment, the shield (6) is inserted onto the ring by joining the two halves (6*a* and 6*b*) of the shield on one side with fastening means loosely securing the two halves by their flanges (28*a* and 28*b*) together at a first side containing opposite facing flanges. The topper halves are then wrapped around the polish rod and secured together by snapping into place through the insertion of the pin (32) into the hook recess (30). FIGS. 12 through 15, illustrate the shield half (6*a* or 6*b*) showing the simplicity of the design. In use once installed, the edge (36) of the shield (6*a*) is inserted into the channel (46) located on the base ring (8). A frustoconical portion (49) is located at the top of the shield (6*a*) while the bottom thereof is cylindrical (58). The cylindrical section (58) allows the adjustment of the device to a height by allowing one to cut the shield in the section.

The topper (4) now secured around the polish rod is then inserted into the shield (6) by wrapping the top of the shield around the bottom section (26) of the topper (4) around its neck (24) allowing only the top (28) of the topper to protrude above the shield (6).

In referring to FIG. 11, the loosely secured shield (6) is then inserted into the channel (46) defined by the outer lip (42) and the inner lip (44) located on the top surface (40) of the base ring (8). Once inserted into the channel (46) the two halves are then further secured together by adding the fastening means to the second side flanges and by further fastening the fastening means initially present on the first side edges of the two halves of the shield. Once secured together, the two halves of the shield provide a liquid seal against rain (from the outside) and oil from the inside along the seam created by the tight contact between the inner lip (44) and the inside wall of the shield (6). Additionally, the secured shield halves (6*a* and 6*b*) can further be secured to the basin (10) by inserting a cord, a bungee cord, tie wrap or an equivalent fastener which attaches the basin to the shield (6) through insertion into an aperture (such as 14*a* and 14*b*) located on the flange portion (28*a* and 28*b*) of the shield (6) and through a hook (66 on FIG. 10) located on the side of the basin (10). Alternatively, one half of the shield could contain both edges and the other half would abut or be inserted into seams located on the first half and be secured in place through friction/pressure.

The topper made up of two halves comprises suitable material around its inside perimeter which will be contacting the polish rod. Felt is the preferred material to accomplish the dual task of maintaining as much as possible rain out of the stuffing box basin and oil inside in the case of the occasional blow out. The felt material is preferably secured to the topper by insertion into a recess or groove located on the inside perimeter thereof.

Preferably, the lower section (26) of the topper (also referred to as the top portion) (4) that is located inside the shield (6) when is use, is bell-shaped. This allows the topper to move freely during lateral movement of the polish rod and also to move up in the event of an oil blow out. This range of motion from the topper substantially minimizes the pressures exerted on the shield by the simple lateral movement of the polish rod (when in operation) or the vertical displacement forces exerted thereon in the event of an oil blow-out. Moreover, the vertical range of movement of the topper permits the rainguard to release built up gases from the stuffing box, thereby reducing the possible risk of explosion associated with built up gas and the presence of sparks or static electricity.

The base ring (8) and the top portion (4) of the device (1) can be made of ABS or polycarbonate. Preferably, polycarbonate is used.

In referring to FIGS. 10 and 11, the outward angle of the inner lip (44) is designed to allow the user installing the shield on the ring to have fewer problems installing the shield. Further, the inner lip is angled outwardly in order to provide a better seal with the bottom edge (36) of the shield (6). The outer lip (42) is angled inwardly in order to catch the rain dripping off the shield (6) and divert it away from the center. In a preferred embodiment, the outer lip (42) defines at least one aperture (64) in its circumference adapted to allow drainage of fluid such as rainwater collected in the space defined by the shield (6) and the outer lip (42) to run off the device and onto the ground.

Figure 21:
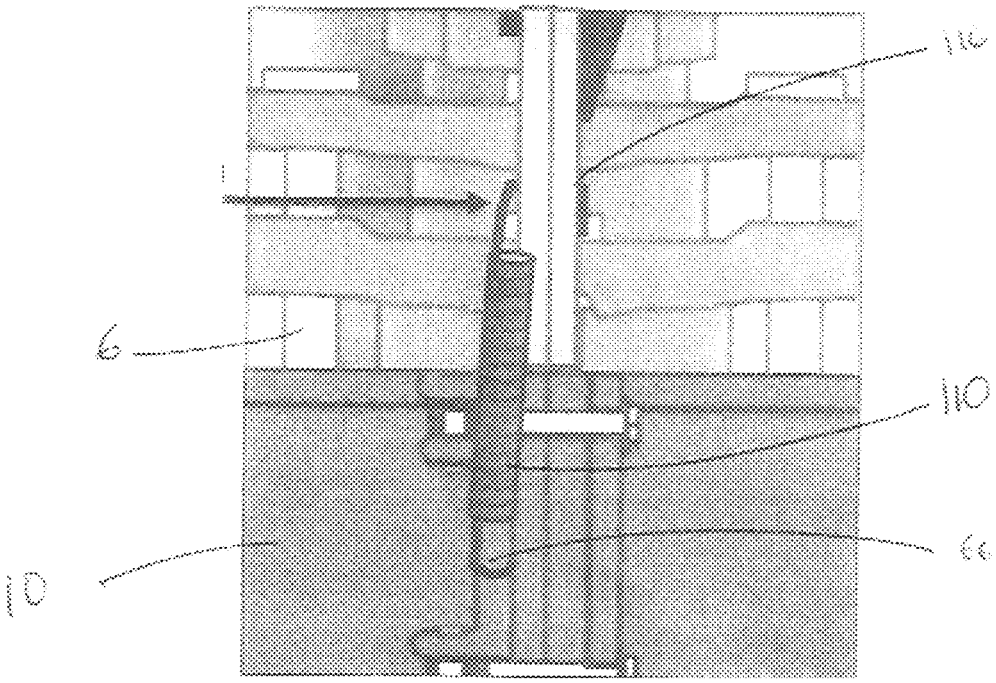
FIG. 21 is a side view of the top edge of the basin showing the attachment between the rainguard and the basin according to a preferred embodiment of the present invention.
Figure 22:
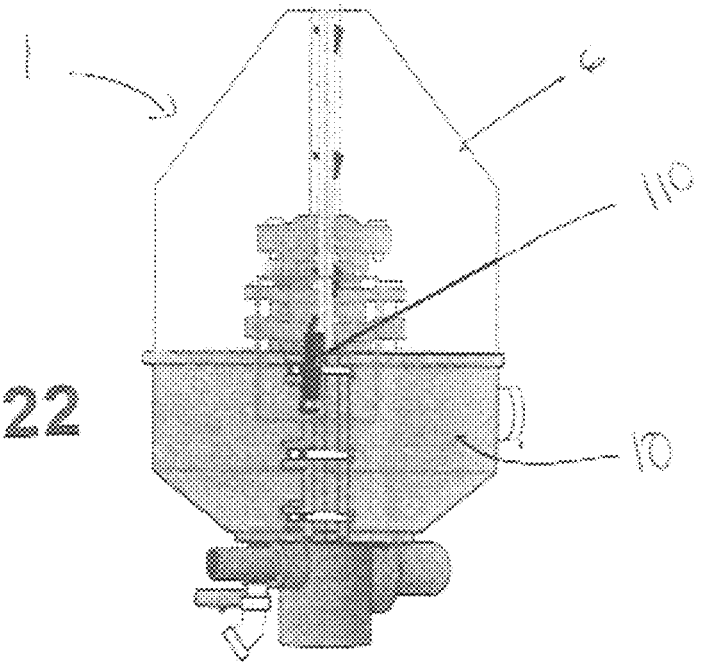
FIG. 22 is a side view of the basin and the rainguard highlighting the attachment between the rainguard and the basin according to a preferred embodiment of the present invention.
Figure 23:
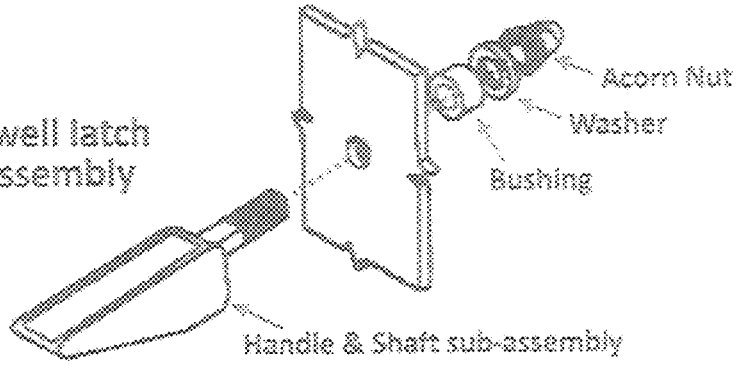
FIG. 23 is an exploded perspective view of the swell latch securing the two half shields of the rainguard according to a preferred embodiment of the present invention.
Figure 24:
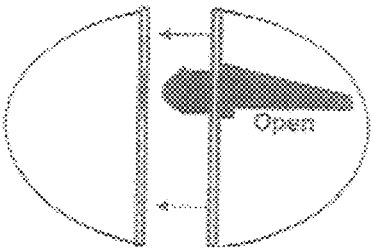
FIG. 24 is a close up side view of the swell latch securing the two half shields of the rainguard in the open position according to a preferred embodiment of the present invention.
Figure 25:
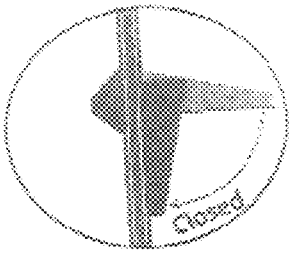
FIG. 25 is a close up side view of the swell latch securing the two half shields of the rainguard in the closed position according to a preferred embodiment of the present invention.

FIG. 22 illustrates the rainguard mounted on a basin (10). FIGS. 23, 24 and 25 are close ups of one of the six swell latches securing the two half shields together according to a preferred embodiment of the present invention. The swell latch assembly (231) comprises a handle and shaft subassembly (232) which shaft goes through an aperture (14*a*) on the flange portion (28*a*) of the shield. The shaft (236) is inserted through a bushing (233), a washer (234) and an acorn nut (235). FIGS. 24 and 25 show the swell latch assembly in the "open" position (FIG. 24) and in the "closed position (FIG. 25). FIG. 21 shows a close up view of a spring (110) used in securing the shield (6) to the basin (10) according to a preferred embodiment. The spring attaches to the basin at a hook (66) and attaches to the shield in an aperture (116) made in the flange (28) of the shield (6).

The rainguard (1) according to the present invention can be used on a containment basin having improved features to permit installation by a single individual.

The containment basin according to the present invention comprises two opposite half shells for installation against each other on a wellhead installation above the pumping T and surrounding the stuffing box. Each portion of the basin defining a half-shell having an aperture at its center to allow for installation around the top extremity of the Flow T. Each half shell further comprises a seam preferably made out of polyurethane along the edge which abuts against the opposite shell. Preferably, one half shell has a seam (90) having a channel running along its center and the opposite half shell has a seam (88) with a ridge running along its center, wherein said ridge is adapted to tightly fit in the channel located on the opposite shell upon installation of the basin.

Each half shell has a bottom and a continuous side walls adapted for sealingly abutting against one another. The two half shells are secured against each another by using bolts located on the edge of each of each shell. More preferably, bolts are located on one side of the basin where they act as a hinge between the two opposite half shells. These bolts referred to as "hinging bolts" (85) connect each opposite half shell to one another and, when loosely mounted, act as a hinge to allow the installation of the basin around the stuffing box to be performed by a single individual. This is different from other stuffing boxes known in the prior art which require at least two individuals for the installation thereof. Each such hinging bolt (85) is inserted into a lip protruding vertically (83) from a position proximate the edge (94*a*) of a first half shell (100). The hinging bolt (85) is threaded into a cross dowel (12) inserted into a lip protruding horizontally (80) from a position proximate the edge (84*a*) of the half shell (102) opposite the first half shell (100).

Once the basin (10) properly surrounds the stuffing box, bolts (86) located on the second side of the shell referred to as the "open side" of the basin, the side opposite the one where the hinging bolts are located referred to as the "hinging side" of the basin, will be slipped into place to secure the two half shells (100 and 102) together.

Figure 8:
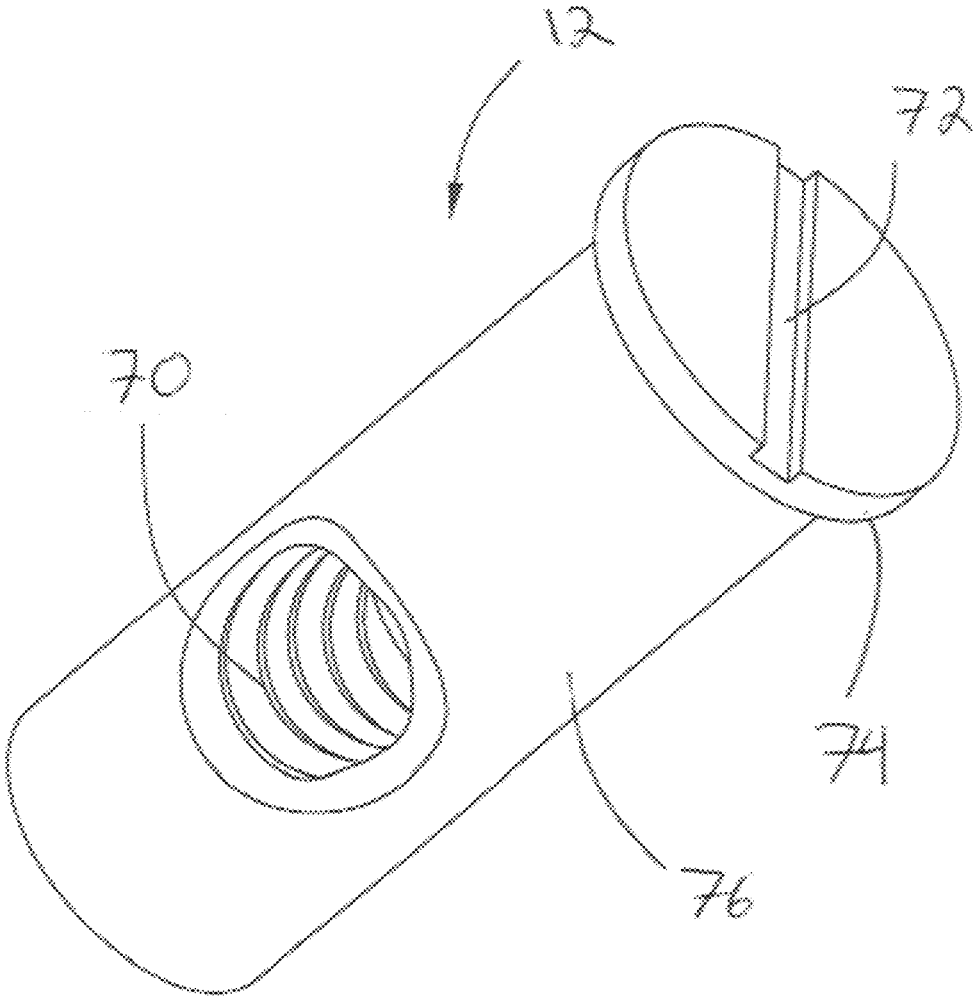
FIG. 8 is a perspective view of the bolts used in securing the shield of the rainguard device according to the present invention.
Figure 16:
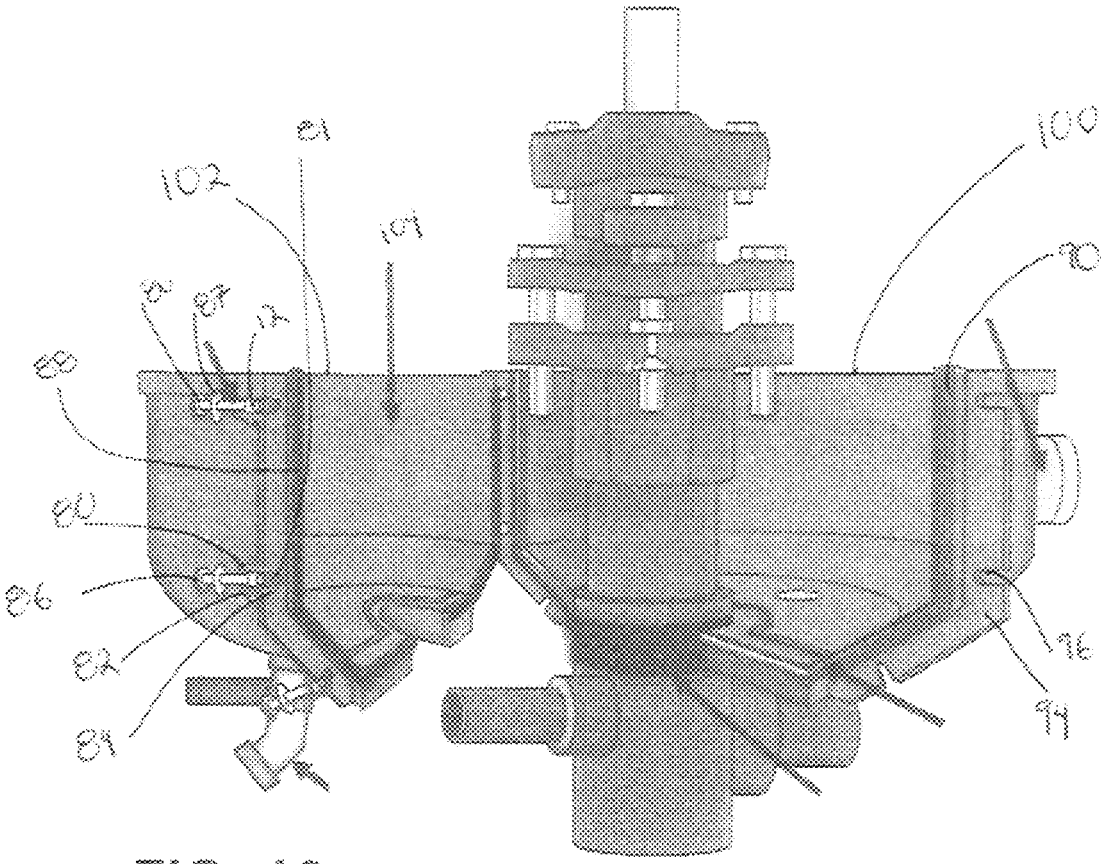
FIG. 16 is a side view of the basin according to the present invention with the two half shells opened at one end and hinged at the opposite end.
Figure 17:
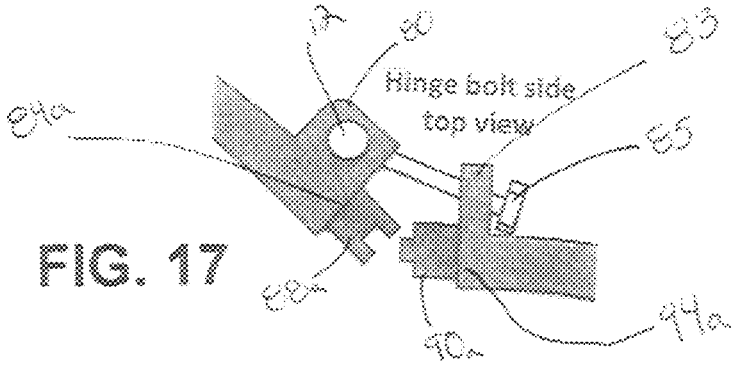
FIG. 17 is a top view of the hinge joining the two half shells of the basin according to a preferred embodiment of the present invention.
Figure 18:
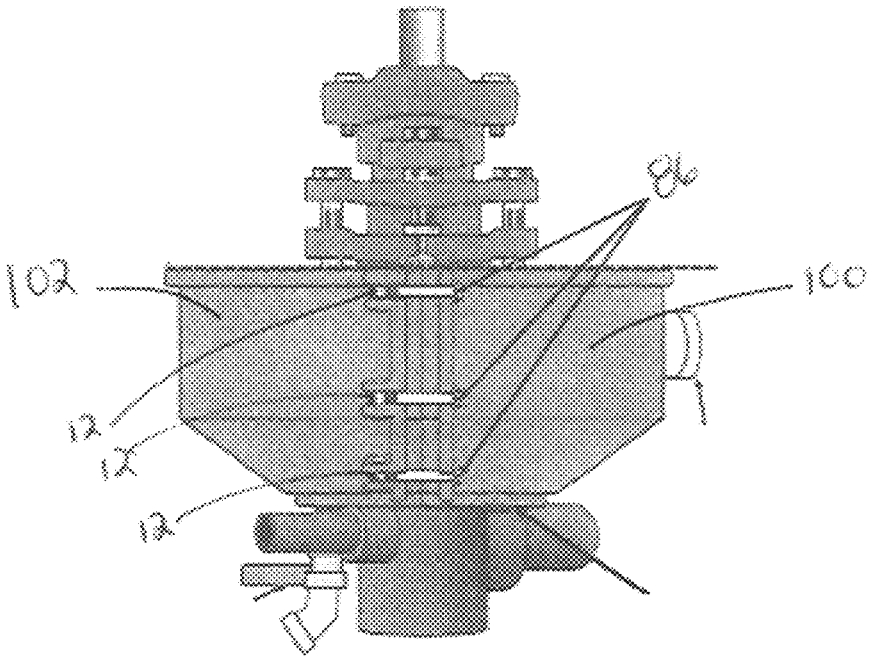
FIG. 18 is a side view of the basin according to the present invention with the two half shells joined and sealed together.
Figure 19:
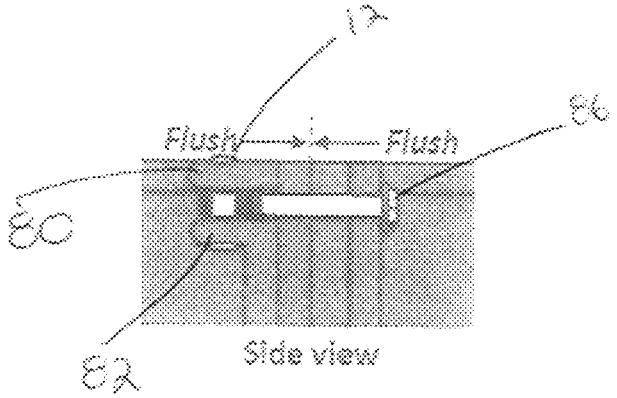
FIG. 19 is a side view of the basin showing the latching bolts sealing the two half shells together according to a preferred embodiment of the present invention.
Figure 20:
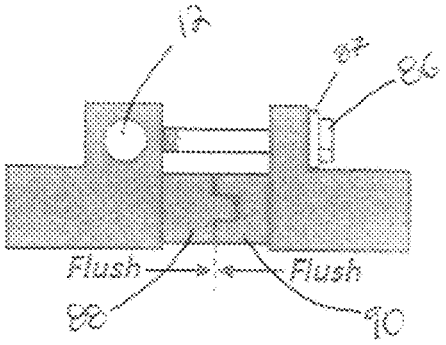
FIG. 20 is a top view of the basin showing the latching bolts sealing the two half shells together according to a preferred embodiment of the present invention.

FIG. 8 shows a perspective view of the barrel nut (12) used in securing the two half shells (100 and 102), see FIG. 16, of the basin (10) according to a preferred embodiment of the present invention.

As seen in FIGS. 16, 17, 18, 19 and 20, the bolts (86) are threaded into a novel type of cross dowel referred to as a barrel nut (12). A cross dowel is a type of fastener consisting of a steel dowel with a threaded hole in its side. In a preferred embodiment, there is preferably a slot (72) at one end of the dowel to allow for a flat head screwdriver to be inserted therein to help in the alignment of the bolt (86) and the nut (12) when inserting the former into the latter. The barrel nut (12) has a head (74) where the slot (72) is located, said head (74) having a wider diameter than the body (76) of the nut (12) so as to not slip through the aperture located on the lip protruding horizontally (80) from a position proximate the edge (84) of the half shell (102). The barrel nut (12) is then inserted into the aperture located on the lip protruding horizontally (80) from a position proximate the edge (84) of the half shell (100). According to a preferred embodiment of the present invention, the protruding lip (80) having an aperture adapted to receive the barrel nut (12). Preferably, the half shell (100) has two lips (80 and 82) spaced apart from one another in such a way as to allow a space (81) between each protruding lip (80 and 82) at least slightly greater than the diameter of the bolt (86) intended to be inserted into the threads (70) of the nut (12). The barrel nut (12) is intended on being inserted into the two protruding lips (80 and 82) so as to allow the threaded aperture (70) to be positioned between the two protruding lips (80 and 82) and thus allow the bolt (86) to be threaded into such. The bolt thus loosely threaded can move through rotation of the barrel nut (12) within the aperture between the protruding lips (80 and 82), therefore acting as a "latching bolt". This rotational freedom of the latching bolt allows the installer to join the two half shells (100 and 102) together and swing in place each latching bolt into a cavity (96) located along the edge (94) of the opposite basin half shell (100) and substantially horizontally to the space (81) between the two lips protruding horizontally (80 and 82) on the opposite half shell.

The barrel nut (12) allows for quick removal and installation of a containment basin (10) according to the present invention by a single individual, by allowing the loosening of the latching bolts without actual removal thereof. The head (74) of the barrel nut (12) allows the installer to insert such into the aperture located on the lips protruding horizontally from the edge of the half shell without having to hold on to them as they will "sit" into the apertures. Conventional methods to bind two half shells of a containment basin use different systems which are prone to loosening and potential breakage if removed or adjusted too many times. The type of attachment disclosed herein is intended on overcoming some of the drawbacks encoutered with prior art devices.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

The invention claimed is:

1. A rainguard device for insertion on top of a stuffing box containment basin, said device comprises:

a top portion;

a shield; and a base ring;

wherein said top portion comprising a flat circular upper section connected at its underside to a neck connected to a lower section; said neck is adapted to be inserted into an aperture present at a top section of the shield; said top portion having a vertical central aperture going therethrough adapted to receive a polish rod;

said shield comprising two halves and having a frustoconical top portion and defining an aperture at the top thereof and having a cylindrical bottom section; said bottom section defining an aperture and adapted to be inserted into the base ring;

said base ring comprising two halves each of which comprising:

a lower edge adapted for insertion into the inside of said basin;

a middle ring portion supporting an inner lip and an outer lip, both inner and outer lips extending upwardly from the middle ring portion and both lips extending around the circumference of the middle ring portion; said inner lip and outer lip defining therebetween a channel adapted to receive an edge of the bottom portion of the shield; and wherein the base ring is adapted to rest on a top edge of the stuffing box containment basin.

2. The rainguard device according to claim 1, wherein the top portion comprises a circumferential groove facing inwardly towards the vertical aperture.

3. The rainguard device according to claim 1, wherein the circumferential groove is adapted to receive a waterproof ring.

4. The rainguard device according to claim 1, wherein the lower section of the top portion is belt-shaped and whose diameter is greater than that of the aperture at the top of the shield.

5. The rainguard device according to claim 1, wherein the top portion is designed to allow the vertical movement of a polish rod.

6. The rainguard device according to claim 1, wherein the flat circular upper section of said top portion has a wider diameter than the aperture at the top of the shield.

7. The rainguard device according to claim 1, wherein lower section has a wider diameter than the aperture at the top of the shield.

8. The rainguard device according to claim 1, wherein the neck has a narrower diameter than the aperture at the top of the shield.

9. The rainguard device according to claim 1, wherein the lower edge of the ring being adapted to be removably connected to the inside of the basin.

10. The rainguard device according to claim 9, wherein the lower edge of the ring can be removably connected to the inside of the basin through at least one bayonet mount present on the base ring interlocking with a pin located on the inside of the basin.

11. The rainguard device according to claim 1, wherein said inner lip is adapted to frictionally fit the bottom section of the shield.

12. The rainguard device according to claim 1, wherein said inner lip is angled outwardly.

13. The rainguard device according to claim 1, wherein said outer lip is angled inwardly.

14. The rainguard device according to claim 1, wherein said outer lip defines at least one aperture in its circumference adapted to allow drainage of fluid.

15. A rainguard device for insertion on top of a stuffing box containment basin, said basin and rainguard device adapted to receive a polish rod therethrough, said device comprises:

a top portion;

a shield; and a base ring;

said shield having a frusto-conical top portion and defining an aperture at the top thereof and having a cylindrical bottom section; said bottom section defining an aperture and adapted to be inserted into the base ring; said shield comprising two halves, each half comprising a flange having facing apertures adapted to receive fastening means to maintain said facing flanges from opposite halves in abutment with one another when in use;

wherein said top portion comprises a flat circular upper section connected at its underside to a neck connected to a lower section; said neck is adapted to be inserted into an aperture present at a top section of the shield; said top portion having a vertical central aperture going therethrough adapted to receive a polish rod; said vertical aperture being fitted with a flexible sealing member adapted to abut against said polish rod and provide a seal;

said base ring comprising two halves having edges adapted to be placed in abutment with one another, said ring comprises:

a middle ring portion supporting an outer lip and an inner lip both extending upwardly therefrom and a lower edge extending downwardly from the middle ring portion;

said lower edge being adapted for frictional insertion into the inside of said basin;

said outer lip and inner lip defining therebetween a channel adapted to frictionally receive an edge of the bottom portion of the shield; and wherein the ring is adapted to rest on a top edge of said basin.

16. The rainguard device according to claim 15, wherein:

the flat circular upper section of said top portion has a wider diameter than the aperture at the top of the shield;

the lower section has a wider diameter than the aperture at the top of the shield; and the neck has a narrower diameter than the aperture at the top of the shield.

* * * * *